US007584843B2

(12) United States Patent
Kutsch et al.

(10) Patent No.: US 7,584,843 B2
(45) Date of Patent: Sep. 8, 2009

(54) POCKET-SIZE HAND-HELD CONTAINER FOR CONSUMER ITEMS

(75) Inventors: John H. Kutsch, Crystal Lake, IL (US); Rutger Thiellier, Chicago, IL (US); Andrew Vest, Midlothian, VA (US); Janet Thompson, Chesterfield, VA (US); Xuam Pham, Glen Allen, VA (US); Robert T. Mitten, Glen Allen, VA (US); Yvonne DeVerry, Midlothian, VA (US); Gary Mengeu, Wheeling, WV (US); Stephen Getsy, Pittsburg, PA (US)

(73) Assignee: Philip Morris USA Inc., Richmond, VA (US)

( * ) Notice: Subject to any disclaimer, the term of this patent is extended or adjusted under 35 U.S.C. 154(b) by 456 days.

(21) Appl. No.: 11/414,341

(22) Filed: May 1, 2006

(65) Prior Publication Data

US 2008/0202955 A1 Aug. 28, 2008

Related U.S. Application Data

(60) Provisional application No. 60/700,014, filed on Jul. 18, 2005.

(51) Int. Cl.
*B65D 85/10* (2006.01)

(52) U.S. Cl. ..... 206/267; 206/37; 220/345.1

(58) Field of Classification Search ..... 206/37, 206/38, 1.5, 242, 259, 267, 236; 220/315, 220/252, 324, 345.1–345.4
See application file for complete search history.

(56) References Cited

U.S. PATENT DOCUMENTS 189,604 A 4/1877 Cauhapé

(Continued)

FOREIGN PATENT DOCUMENTS

CH 529013 10/1972

(Continued)

OTHER PUBLICATIONS

International Search Report and Written Opinion dated May 10, 2007 for PCT/IB2006/003253.

(Continued)

*Primary Examiner*—Luan K Bui
(74) *Attorney, Agent, or Firm*—Buchanan Ingersoll & Rooney PC

(57) ABSTRACT

A pocket-size hand-held container for containing a supply of consumer items comprises a frame, a lid, and preferably a bag is disposed in the container for holding the items being stored. The frame includes front and back portions, top and bottom portions, and side portions, the frame forming an internal storage compartment that stores the items. The front portion forms an access opening for the storage compartment, the access opening being situated closer to the top end portion than to the bottom end portion. The lid is attached to the front portion to be slid linearly between fully closed and fully open positions. In its fully closed position, the lid overlies the access opening, and in its fully open position, the lid lies within the footprint of the container. A securement structure formed by the lid and the frame yieldably holds the lid in the closed position. The bag is formed of a flexible plastic material and includes an openable window situated behind the access opening.

17 Claims, 9 Drawing Sheets

U.S. PATENT DOCUMENTS

| | | | | |
|---|---|---|---|---|
| 224,096 | A | 2/1880 | Lorillard, Jr. | |
| 1,163,773 | A | 12/1915 | Ross | |
| 1,906,742 | A | 5/1933 | Coulapides | |
| 2,037,912 | A | 4/1936 | Lisner | |
| 2,050,079 | A | 8/1936 | Zell | |
| 2,076,353 | A | 4/1937 | Samstag | |
| 2,099,122 | A | 11/1937 | Kreisler | |
| 3,007,623 | A | 11/1961 | Clemens | |
| 3,039,671 | A | 6/1962 | Chiamardas | |
| 3,112,029 | A | 11/1963 | Davey | |
| 3,226,010 | A | 12/1965 | Rogers, Jr. | |
| 3,325,000 | A | 6/1967 | Edwards | |
| 3,367,551 | A | 2/1968 | Wheeler | |
| 3,711,011 | A | 1/1973 | Kugler | |
| 3,987,891 | A | 10/1976 | Horvath | |
| 4,076,117 | A | 2/1978 | Wisdom et al. | |
| 4,113,098 | A | 9/1978 | Howard | |
| 4,126,224 | A | 11/1978 | Laauwe et al. | |
| 4,174,034 | A | 11/1979 | Hoo | |
| 4,364,488 | A | 12/1982 | Anjou | |
| 4,485,915 | A | 12/1984 | Berghahn | |
| 4,561,544 | A | 12/1985 | Reeve | |
| 4,589,430 | A | 5/1986 | Sussman | |
| 4,709,399 | A | 11/1987 | Sanders | |
| 4,723,301 | A | 2/1988 | Chang | |
| 4,727,890 | A | 3/1988 | Vincent | |
| 4,741,441 | A | 5/1988 | Keffeler | |
| 4,819,829 | A * | 4/1989 | Rosten et al. | 220/345.3 |
| 4,840,270 | A | 6/1989 | Caputo et al. | |
| 4,844,284 | A | 7/1989 | Drozd et al. | |
| 4,880,712 | A * | 11/1989 | Gordecki | 220/345.2 |
| 4,932,547 | A | 6/1990 | Rodriguez | |
| 5,074,412 | A | 12/1991 | White | |
| 5,080,222 | A | 1/1992 | McNary | |
| 5,082,137 | A | 1/1992 | Weinstein | |
| 5,092,354 | A | 3/1992 | Pacelli, Jr. | |
| 5,135,822 | A * | 8/1992 | Okamoto | 429/97 |
| 5,145,091 | A | 9/1992 | Meyers | |
| 5,180,056 | A | 1/1993 | Adams et al. | |
| 5,201,413 | A | 4/1993 | DeBlasio et al. | |
| 5,205,403 | A | 4/1993 | DeBlasio et al. | |
| 5,275,291 | A | 1/1994 | Sledge | |
| D352,895 | S | 11/1994 | van Loo | |
| 5,373,862 | A | 12/1994 | Blachut | |
| 5,531,325 | A | 7/1996 | Deflander et al. | |
| 5,605,167 | A | 2/1997 | Montoli | |
| 5,630,503 | A | 5/1997 | Rhodes et al. | |
| D384,538 | S | 10/1997 | Bosworth | |
| 5,799,781 | A | 9/1998 | Arthur | |
| 5,848,595 | A | 12/1998 | Arthur | |
| D406,487 | S | 3/1999 | Attar et al. | |
| D407,972 | S | 4/1999 | Hilton | |
| 5,899,326 | A | 5/1999 | Benhamou et al. | |
| 5,908,246 | A | 6/1999 | Arimura et al. | |
| 5,938,013 | A | 8/1999 | Palumbo et al. | |
| 5,996,797 | A | 12/1999 | Flaig | |
| 6,050,449 | A | 4/2000 | Kanj | |
| 6,076,679 | A | 6/2000 | Yuhara et al. | |
| 6,113,271 | A | 9/2000 | Scott et al. | |
| 6,199,695 | B1 | 3/2001 | Takeo | |
| 6,237,776 | B1 | 5/2001 | Mogil | |
| 6,244,434 | B1 | 6/2001 | Brooks | |
| D446,718 | S | 8/2001 | Anderson | |
| D451,799 | S | 12/2001 | Berger et al. | |
| 6,341,693 | B2 | 1/2002 | Konno et al. | |
| 6,341,710 | B1 | 1/2002 | Danielson et al. | |
| D460,352 | S | 7/2002 | Bried | |
| D465,729 | S | 11/2002 | Nishimura | |
| D494,466 | S | 8/2004 | Devine | |
| D497,246 | S | 10/2004 | Darst | |
| D497,803 | S | 11/2004 | Nichols et al. | |
| 6,823,989 | B2 | 11/2004 | Wilder et al. | |
| 6,929,400 | B2 | 8/2005 | Razeti et al. | |
| 6,971,521 | B2 | 12/2005 | Pinyot | |
| 6,976,577 | B2 * | 12/2005 | Devine | 206/37 |
| 7,114,504 | B2 | 10/2006 | Fox | |
| 7,114,619 | B2 * | 10/2006 | Ellis et al. | 206/1.5 |
| 7,124,883 | B1 | 10/2006 | Thomas et al. | |
| 7,147,127 | B2 | 12/2006 | Lepke et al. | |
| 2002/0000389 | A1 | 1/2002 | Garcia | |
| 2004/0056035 | A1 | 3/2004 | Baker et al. | |
| 2004/0173613 | A1 | 9/2004 | Schroeder et al. | |
| 2005/0117819 | A1 | 6/2005 | Kingsford et al. | |
| 2005/0207680 | A1 | 9/2005 | Schumacher et al. | |
| 2006/0283721 | A1 | 12/2006 | Kutsch et al. | |
| 2007/0012711 | A1 | 1/2007 | Kutsch et al. | |
| 2008/0202955 | A1 | 8/2008 | Kutsch et al. | |

FOREIGN PATENT DOCUMENTS

| | | |
|---|---|---|
| DE | 2544743 | 4/1977 |
| FR | 1457910 A | 1/1966 |
| GB | 2174075 | 10/1986 |
| JP | 11206443 | 8/1999 |
| NL | 6401066 | 8/1965 |
| WO | 03/094823 A | 11/2003 |
| WO | WO 03/094823 | 11/2003 |

OTHER PUBLICATIONS

Partial International Search Report dated May 3, 2007 for PCT/IB2006/003333.

International Search Report and Written Opinion dated Aug. 16, 2007 for PCT/IB2006/003333.

John H. Kutsch et al., "*Container for Consumer Article*," U.S. Appl. No. 11/142,420, filed Jun. 2, 2005.

John H. Kutsch et al., "*Container for Consumer Article*," U.S. Appl. No. 11/486,038, filed Jul. 14, 2006.

International Search Report and Written Opinion dated Feb. 9, 2007 for PCT/IB2006/002909.

* cited by examiner

POCKET-SIZE HAND-HELD CONTAINER FOR CONSUMER ITEMS

This application claims the benefit of the filing date of U.S. Provisional Patent Application No. 60/700,014 filed Jul. 18, 2005, the subject matter of which is hereby incorporated by reference.

BACKGROUND

This invention relates to a container adapted to hold a number of consumer items, and in particular to a pocket-size container that can be held and opened by one hand of a consumer to expose the items therein.

It would be desirable to provide a small, pocket-size container adapted to be easily held by a consumer in one hand and opened by a finger or thumb of that hand, while leaving the other hand free. In that way, the consumer can retrieve items from the container while leaving the other hand free to perform other functions. By being pocket-size, the container can be easily carried by the consumer and always available.

It would also be desirable for such a container to be economical by comprising few parts capable of simple and rapid assembly.

SUMMARY

There is provided a pocket-size hand-held container for containing a supply of consumer items. The container comprises a frame, a lid, and preferably contains a bag for holding the items being stored. The frame includes front and back portions, top and bottom portions, and side portions, the frame forming an internal storage compartment that stores the items. The front portion forms an access opening for the storage compartment, the access opening being situated closer to the top end portion than to the bottom end portion. The lid is attached to the front portion to be slid linearly between fully closed and fully open positions. In its fully closed position, the lid overlies the access opening, and in its open position, the lid Preferably, the bag is formed of a flexible plastic material and includes an openable window situated behind the access opening.

DETAILED DESCRIPTION OF PREFERRED EMBODIMENTS

Shown in the accompanying drawings is a pocket-size container capable of being held in one hand of a consumer and opened by a finger or thumb of that hand. The container, which is preferably formed of only three pieces, preferably contains a hermetically sealed bag which contains items to be dispensed. An openable window on the bag situated behind an access opening of the container facilitates access to the contained items.

Figure 1:
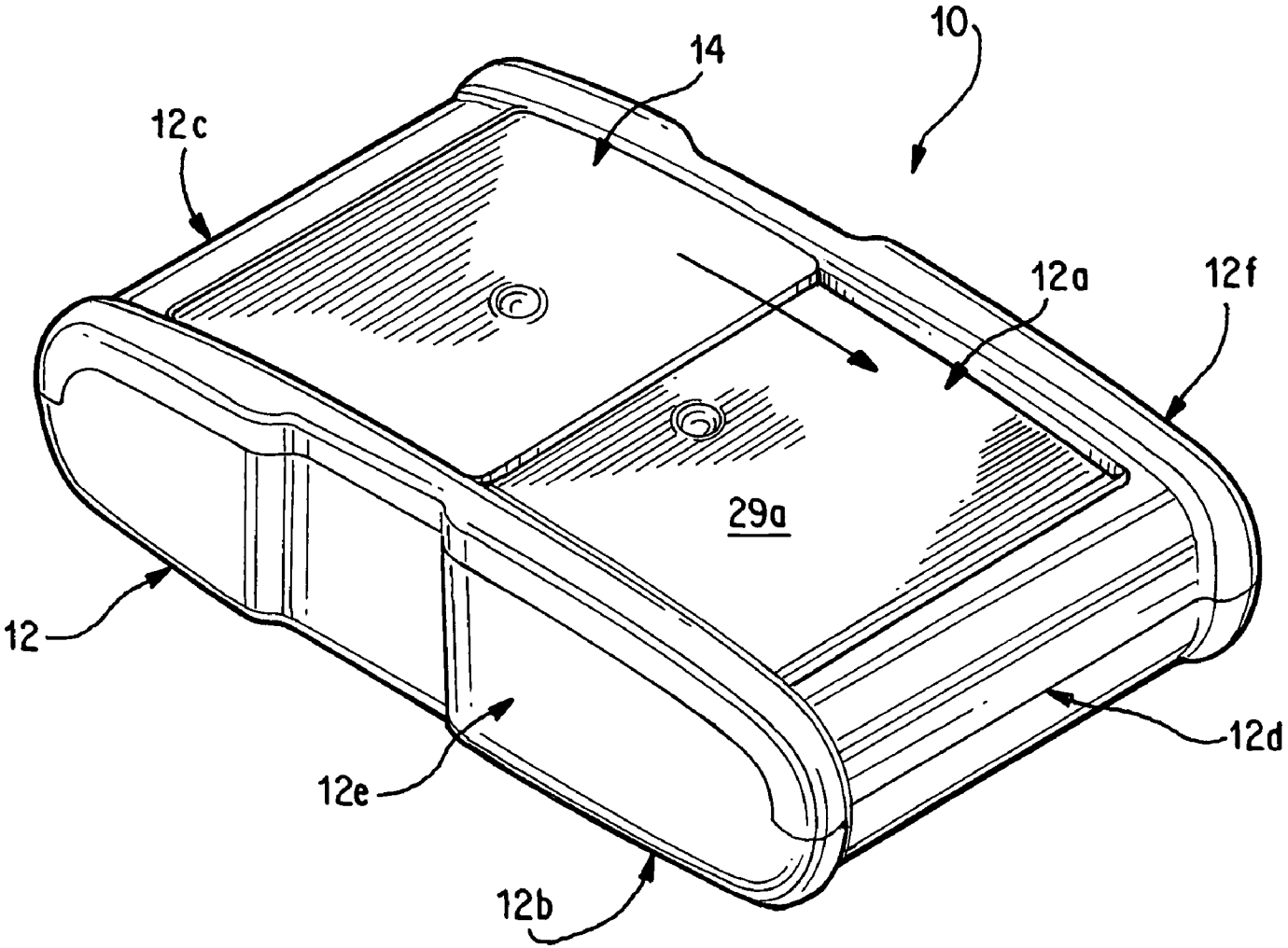
FIG. 1 is a frontal perspective view of a pocket-size hand-held container, with the lid thereof in a closed state.
Figure 2:
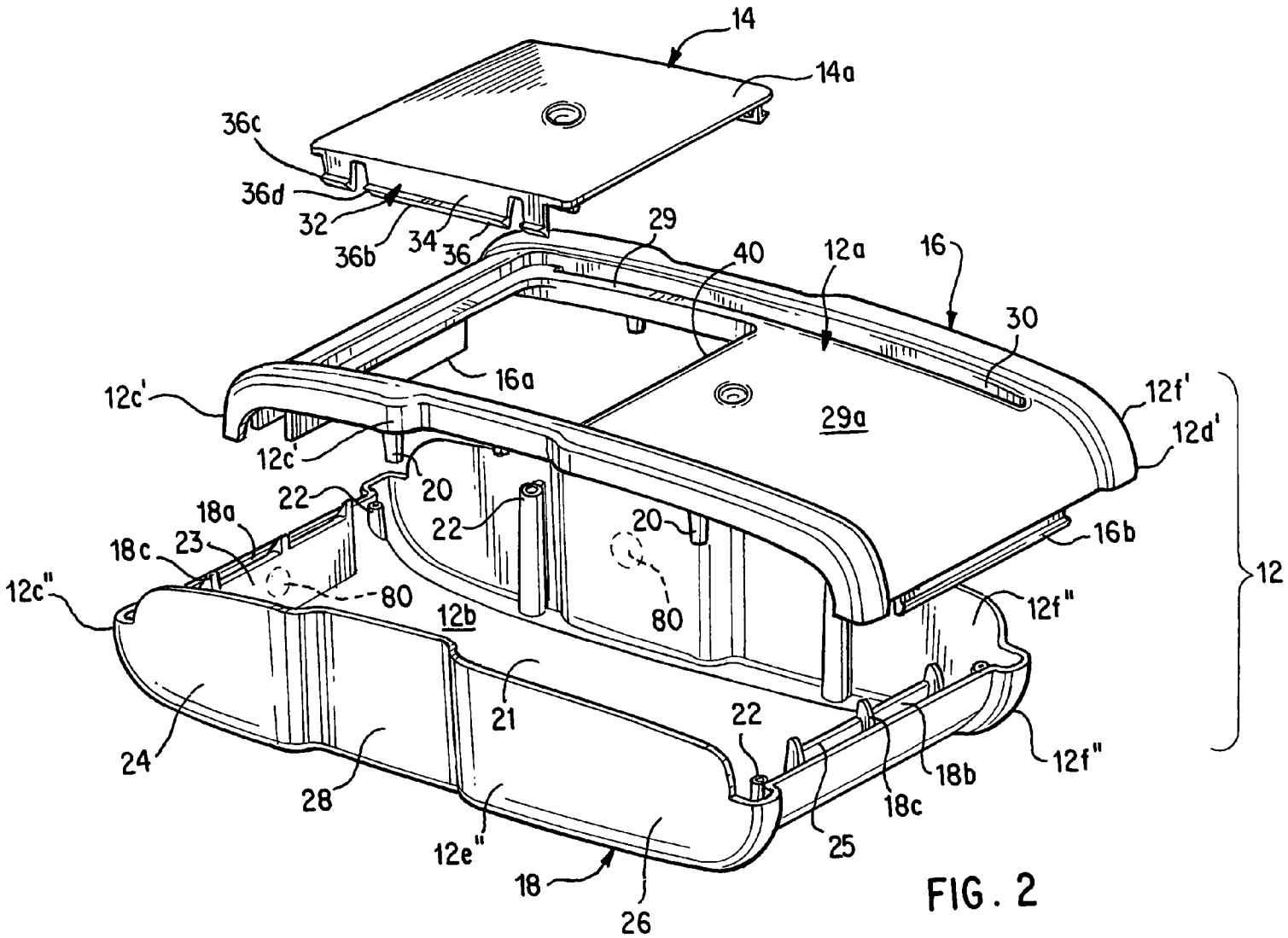
FIG. 2 is an exploded perspective view of the container shown in FIG. 1.
Figure 3:
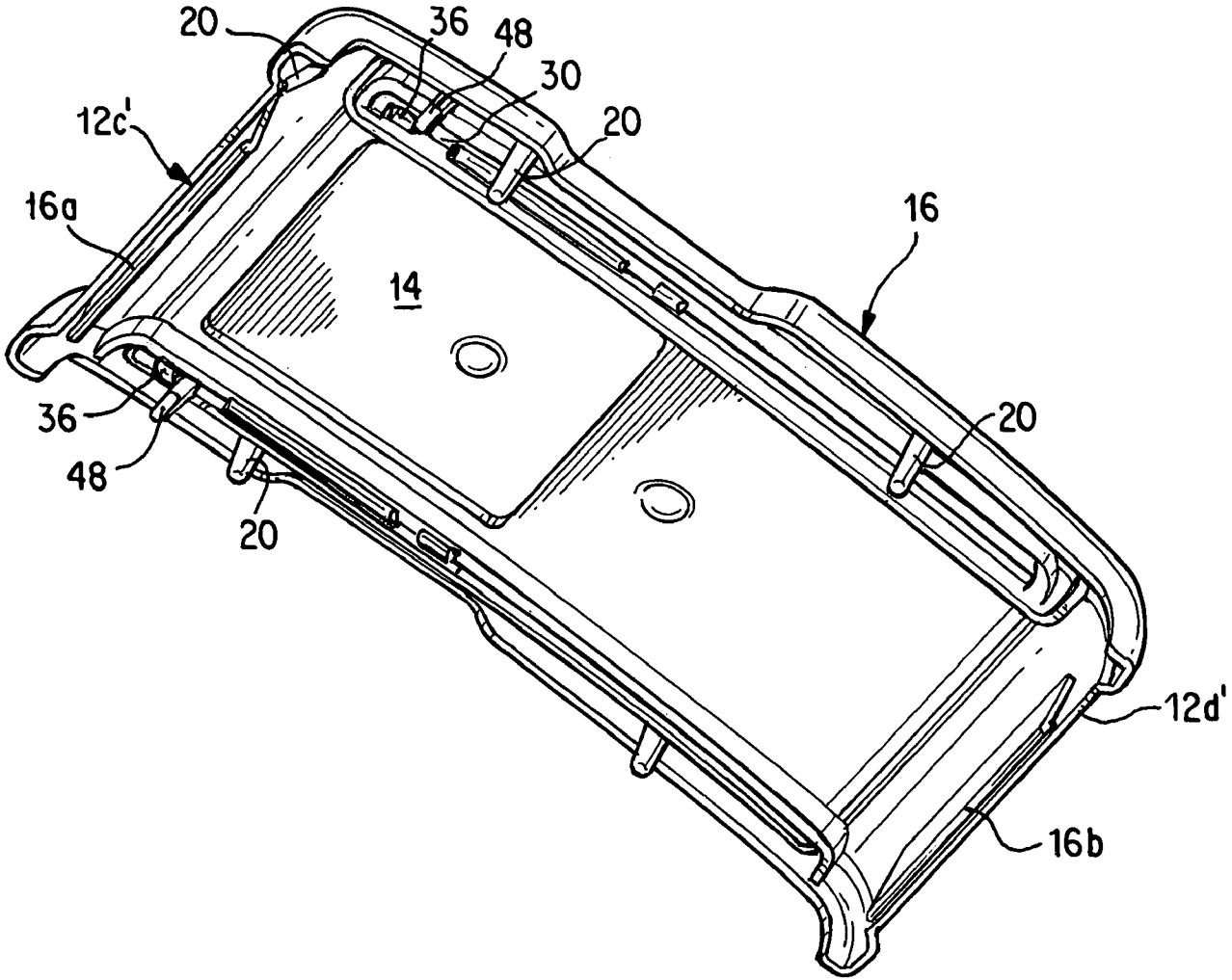
FIG. 3 is a perspective view from beneath a front part of a frame of the container.

As shown in FIGS. 1 and 2, the three-piece container 10 comprises a two-part frame 12 and a lid 14 slidably attached to the frame. The frame 12 defines front and back portions 12*a*, 12*b*, a top portion 12*c*, a bottom portion 12*d*, and side portions 12*e*, 12*f* interconnecting the top and bottom portions. As can be seen in FIG. 2, the frame 12 is formed by two parts secured together, namely a front part 16 and a back part 18 each molded of a single piece of plastic. The front part defines the front portion 12*a*, as well as an upper section 12*c*' of the front portion 12*a*, a front section 12*d*' of the bottom portion 12*d*, and front sections 12*e*', 12*f*' of respective side portions 12*e*, 12*f*.

The back part 18 forms the back portion 12*b*, as well as a back section 12*c*" of the top portion 12*c*, a back section 12*d*" of the bottom portion 12*d*, and back sections 12*e*", 12*f*" of respective side portions 12*e*, 12*f*. The top and bottom portions 12*c*, 12*d* are intersected by a longitudinal axis L (FIG. 4) which extends parallel to the side portions 12*e*, 12*f*.

The front part 16 includes rearwardly projecting pins 20 that are receivable in respective sockets 22 disposed in the back part 18, thereby securing the front and back parts together. The pins 20 and sockets 22 are located so that the front part 16 can be attached to the back part 18 in only one position, i.e., with the portions 12*c*', 12*d*' mating with the portions 12*c*" and 12*d*" respectively.

Projecting rearwardly from the underside of the front part 16 are top and bottom narrow plates 16*a*, 16*b* which are adapted to engage the longitudinally outward sides of ribs 18*c* formed on the plates 18*b* when the parts 16, 18 are attached together, in order to position the parts such that the posts 20 and sockets 22 become mutually aligned as they approach one another. When attached together, the front and back parts form an internal storage compartment 21 for receiving items to be dispensed, the items preferably disposed within a holder, such as a bag, as will be discussed.

Each of the side portions 12*e*, 12*f* includes top and bottom regions 24, 26, and an intermediate region 28 (see FIG. 4) that is recessed with respect to the top and bottom regions 24, 26 in order to facilitate single-handed operation by a consumer (see FIG. 1). In particular, when the container is held in the palm of a consumer's hand, the recesses 28 provide convenient shoulders that may be grasped by one or two fingers of the consumer's hand, enabling the consumer to slide open the lid with a remaining digit, such as a thumb.

Figure 5:
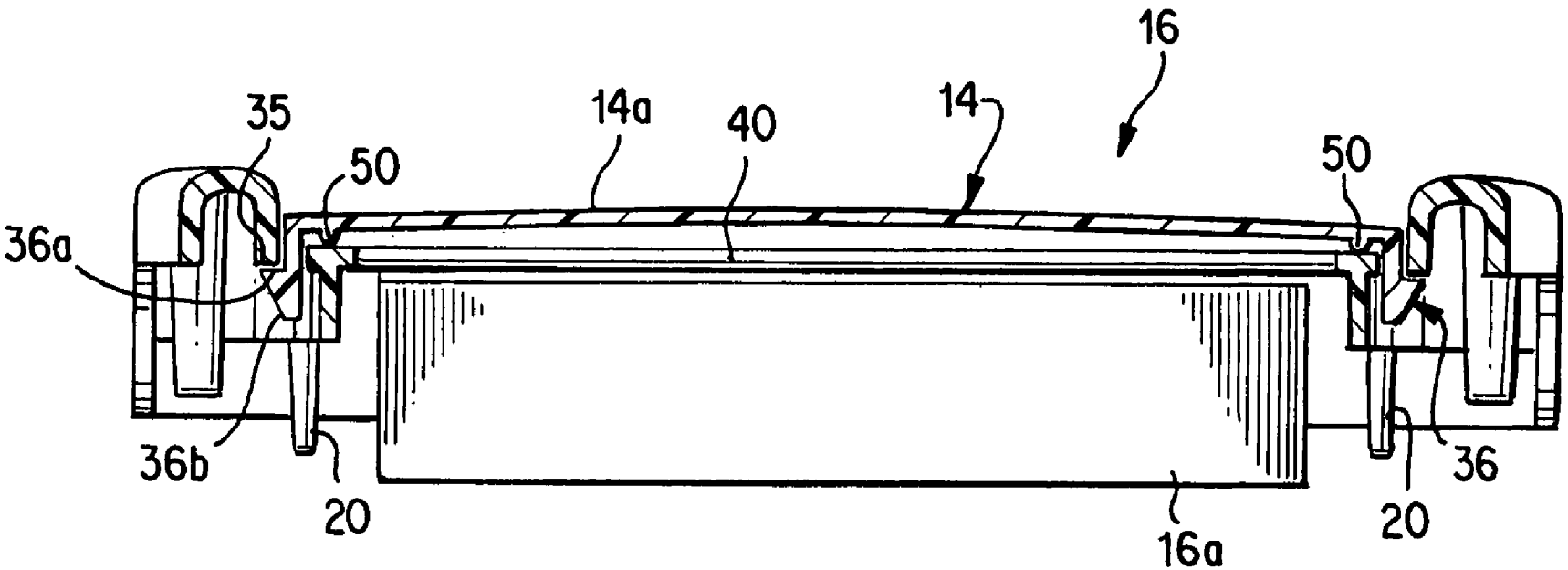
FIG. 5 is a cross-sectional view taken through the frame's front part along the section line 5-5 in FIG. 4.

The front portion 12*a* includes a front surface 29 in which is formed a pair of slots or channels 30 extending parallel to one another and longitudinally, i.e., parallel to respective side portions 12*e*, 12*f*, which is slidable longitudinally. The lid 14 includes a pair of rails or guide strips 32, each rail comprising a rearwardly projecting rib 34 and an enlarged head (or claw) 36 at a back end of each rib. Each head 36 includes a forwardly facing surface 36*a* underlying a rearwardly facing surface 35 of the front frame portion 16, and also includes a rearwardly facing beveled surface 36 (see FIG. 5). The beveled surface is beveled forwardly and outwardly from the respective rib to define a wedge surface which facilitates installation of the lid. That is, by pushing the lid rearwardly onto the frame 12 such that the rails 32 approach respective slots 30, the wedge surfaces cause the back ends of the rails to be displaced laterally inwardly to enter the respective slots 30. Then, the back ends of the rails rebound back laterally outwardly to enable the forwardly facing surfaces 36*a* to underlie the surface 35 (formed by the rear side of the front part 18 in this embodiment), to prevent the lid from being unintentionally removed from the frame. Such a snap-in installation feature simplifies the assembling of the container.

Each enlarged head 36 includes a gap, or interruption 36*d* along its length (see FIG. 8A), whereby a top portion 36*c* of each head 36 is spaced from the rest of the head, for reasons to be explained hereafter.

The front surface 29 includes an access opening 40 which provides access to the inner compartment formed by the frame. The access opening 40 is disposed closer to the top portion 12*c* of the frame than to the bottom portion 12*d* thereof, whereby the access opening is spaced from the frame's bottom portion by a bottom portion 29*a* of the front surface.

Figure 4:
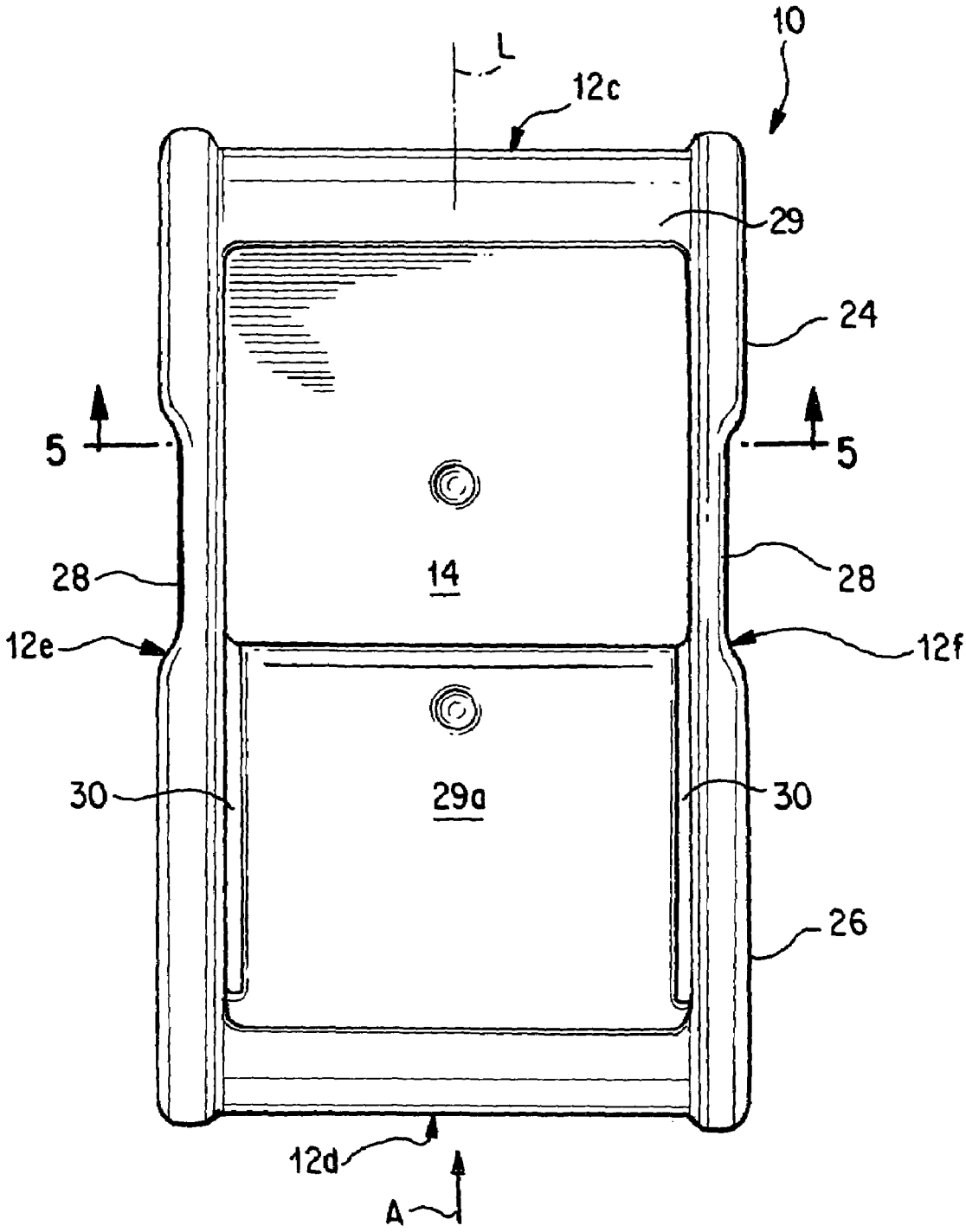
FIG. 4 is a frontal plan view of the container shown in FIG. 1.
Figure 7:
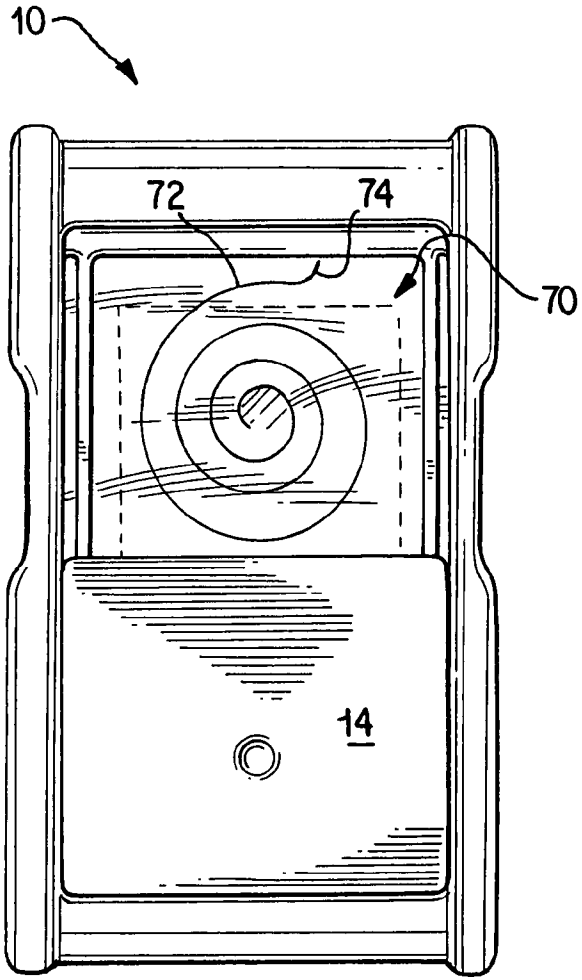
FIG. 7 is a view similar to FIG. 6 showing an alternative configuration of the item-containing bag.
Figure 6:
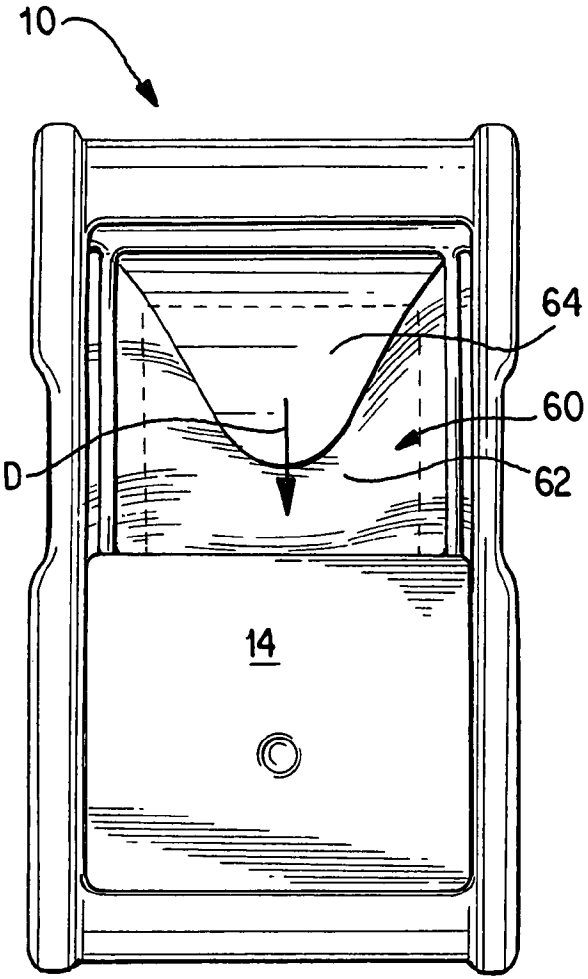
FIG. 6 is a frontal plan view of the container, with the lid in an open state exposing a first embodiment of an item-containing bag disposed within the container.

The lid 14 is adapted to be slid from a closed position in which it overlies the access opening 40, as shown in FIG. 4, to an open position, shown in FIGS. 6 and 7, in which the lid exposes the access opening, while still being situated within the footprint of the frame, i.e., the lid is still situated between the top, bottom, and side portions of the frame. This facilitates one-handed manipulation of the container because movement of the lid will not be obstructed by the consumer's hand.

Figure 8A:
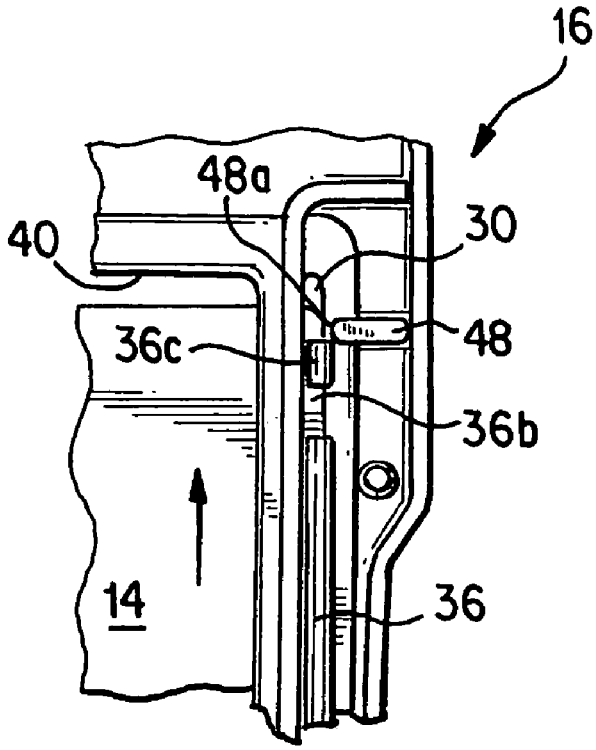
FIG. 8A is an enlarged fragmentary rear view of the rear-side of the frame's front part as the lid approaches a fully closed position.
Figure 8B:
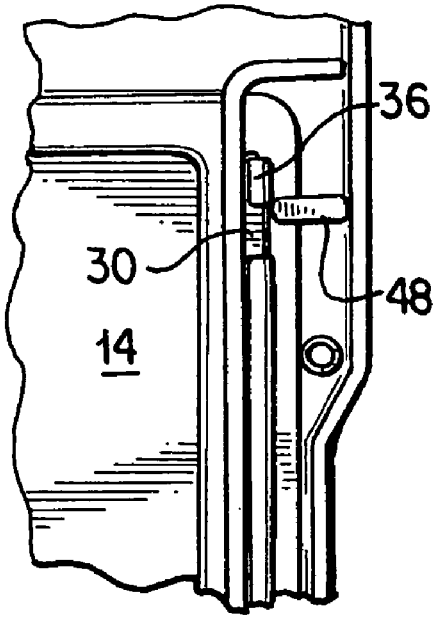
FIG. 8B is a view similar to FIG. 8*a* after the lid reaches a fully closed position.
Figure 9:
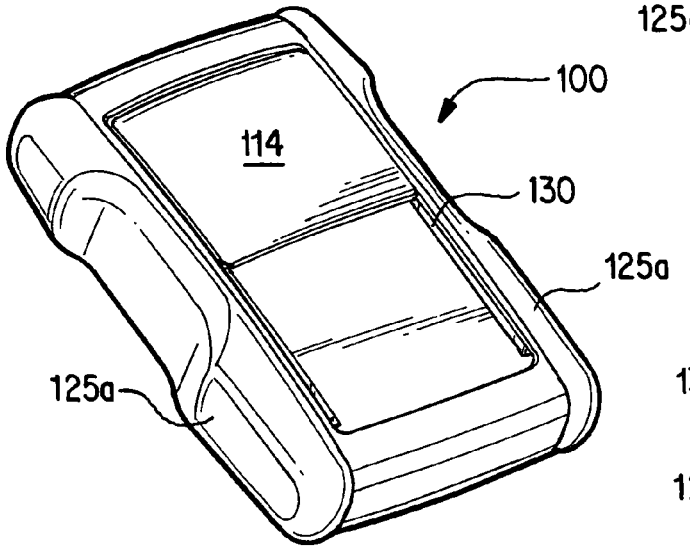
FIG. 9 is a frontal perspective view of an alternative embodiment of a pocket-size hand-held container.
Figure 10:
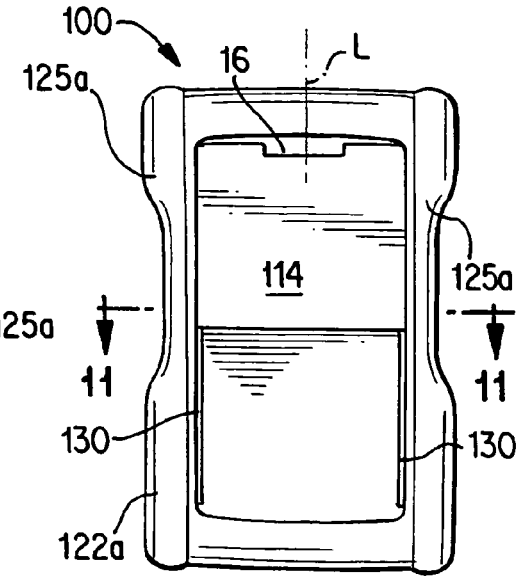
FIG. 10 is a frontal plan view of FIG. 11.

In the closed position, the lid 14 is secured by a securement mechanism which is yieldable to manual pressure. For example, a lug 48 is disposed on the frame 12 adjacent each slot 30, as shown in FIG. 8A. The top portions 36*c* of the enlarged heads 36 of the rails 32 are configured to project slightly laterally outwardly past the respective slots 30 (i.e., laterally to the right in FIG. 8A) and slightly laterally past an inner face 48*a* of the lug. Thus, there will be created some frictional resistance to travel of the head portion 36*c* past the lug as the lid is being opened and closed. Since the frame and the lid are formed of plastic, it is possible for the head portions 36*c* and/or lug 48 to yield sufficiently under manual pressure, to enable the head portion 36*c* (and thus the lid) to travel past the lug. When the lid has been fully closed each lug 48 will lie in the gap 36*d* of a respective rail 32.

Disposed on the rear side of the lid 14 are two downwardly projecting longitudinal ridges 50 (see FIG. 5) arranged adjacent respective rails 32 and slidably bearing against the front surface 29 of the front portion 12*a* at locations laterally inwardly of the slots 30. The ridges 50 keep the main portion 14*a* of the lid spaced forwardly of that front surface 29 to minimize sliding friction and prevent the lid from scraping against and abrading any product-identifying label that may be attached to the bottom portion 29*a* of the front surface 29. Also, the surface portion 29*a* is slightly concave from adjacent one side portion 12*e* to adjacent the other side portion 12*f*. That is, the concavity is visible when viewed in the direction of arrow A in FIG. 4. This further recesses a label from the main portion of the lid. In lieu of being disposed on the lid 14, the ridges 50 could instead be disposed on the front surface 29 for engagement with the rear side of the lid.

Preferably, the lid 14 is configured so as to be symmetrical about two perpendicular planes corresponding to the lines 5-5 and L, respectively, shown in FIG. 4, which planes correspond to the lateral and longitudinal directions of the container, respectively. Such a symmetrical configuration enables the lid to be inserted in either of two positions, i.e., the position shown in FIG. 4, or a position rotated 180° from that position, in order to simplify the assembly of the container.

Preferably, the compartment 21 contains an item holder, preferably a bag formed of flexible plastic or web or a laminate in which the consumer items are disposed. The bag is preferably hermetically sealed and includes a window arranged behind the access opening 40. The window, which could be integral with, or separate from, the rest of the bag, can be pulled open by the consumer. The window could be resealable, if desired, or completely removable to be discarded. Although the window can comprise any convenient configuration, two examples 60, 70 thereof are shown in FIGS. 6 and 7, respectively.

The bag 60 shown in FIG. 6 includes a window 62 having a tongue 64 sized to be manually gripped by a consumer and pulled in the direction of arrow D in that figure. The window could be held to the rest of the bag by an adhesive strip disposed around three of its sides, enabling the window to be resealed after use. Alternatively, the window could comprise a tear-away section to be torn off and discarded.

In FIG. 7, is shown a bag 70 which incorporates a spiral tear-away strip 72 situated behind the access opening. A free end 74 of the strip adapted to be grasped and pulled-on by a consumer.

The particular dimensions and proportions of the container are not critical. The proportions are preferably selected to provide a container which is suitably sized to accommodate the particular items to be packaged therein. Thus, the actual container could be more elongated than shown in the drawings, or the container could be more nearly square, i.e., shorter than shown in the drawings. Preferably, however, the container is sized so it can be conveniently carried in a pocket, and held and opened by one hand of a consumer.

The items can be arranged in various ways. For example, the products could be arranged with the items overlapped or staggered relative to one another. Of course, if the products are small enough, they could be randomly placed in the bag.

The container could, of course, be used for a variety of products. One specific product for which the container can be used is commercially available smokeless pouched tobacco. Such tobacco is provided in packets, sometimes known as "snus" and comprise individual packets of tobacco material.

It will be appreciated from the foregoing that there is provided an inexpensive pocket-size container capable of holding multiple items, and capable of being held and opened in one hand of a consumer.

Assembly of a container is very simple. The item-containing bag 60 or 70 is inserted into the back part 18 of the frame, and is preferably held by glue spots 80 disposed at suitable places on the frame, e.g., on front and/or back surfaces of the compartment, on mutually facing inner surfaces of the plates 18*a*, 18*b*, respectively, and on the recessed portions 28. Two of such glue spots 80 are depicted in FIG. 2 in broken lines. Next, the front part 16 is inserted onto the back part 18 whereupon the plates 16*a*, 16*b* slide along the ribs 18*c* of the plates 18*a*, 18*b*, respectively, to align the pins 20 with their respective sockets 22 and thus facilitate mating thereof. The pins and sockets can be sized to provide a snug frictional fit, and/or held together by glue. The lid 14 can be installed on the top part 18 either before or after the top and bottom parts are secured together. The lid can be secured in either of two positions, due to the symmetrical configuration thereof as explained earlier. In use, a consumer grips the underside of the frame 12 in the palm of his/her hand, the gripping action being facilitated by the presence of the recesses 28, while another digit of the consumer's hand, preferably the thumb, presses against, and slides the lid 14. Since the lid, when fully opened, remains within the footprint of the container, it can be easily opened without abutting the consumer's palm as could be the case if the lid were so long that the bottom portion thereof traveled outside of the container's footprint.

The hermetically sealed bag 60, 70 keeps the items in a fresh state until ready for use, and can be conveniently opened, and optionally resealed.

The container is preferably enclosed in a shrink-wrap enclosure which includes a tear strip along one side for opening the shrink wrap.

It will thus be appreciated that the container can be made inexpensively, i.e., from molded plastic pieces, and easily assembled. The container can be easily manipulated in one hand and provides a friction securement for the closed lid. The main part of the lid is constrained to travel above the front surface 29*a* therebeneath in order to prevent abrading of any indicia-containing labels disposed on that surface.

Figure 13:
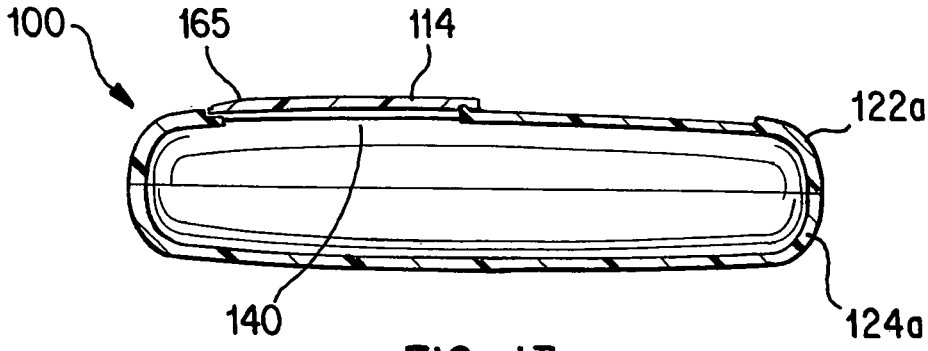
FIG. 13 is a sectional view taken along line 13-13 in FIG. 11, with a lid of the container in a closed state.
Figure 14:
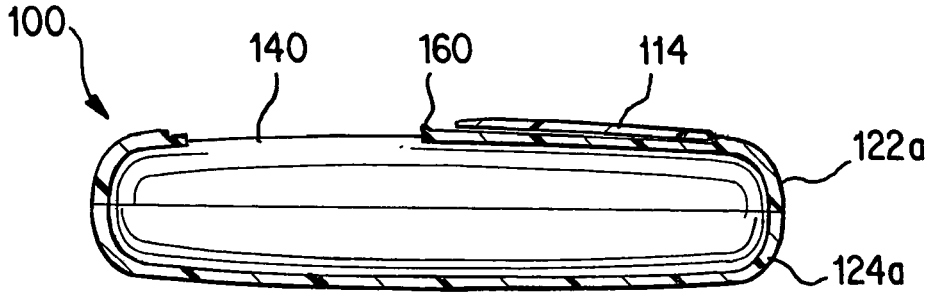
FIG. 14 is a view similar to FIG. 13, with the lid in an open state.
Figure 15:
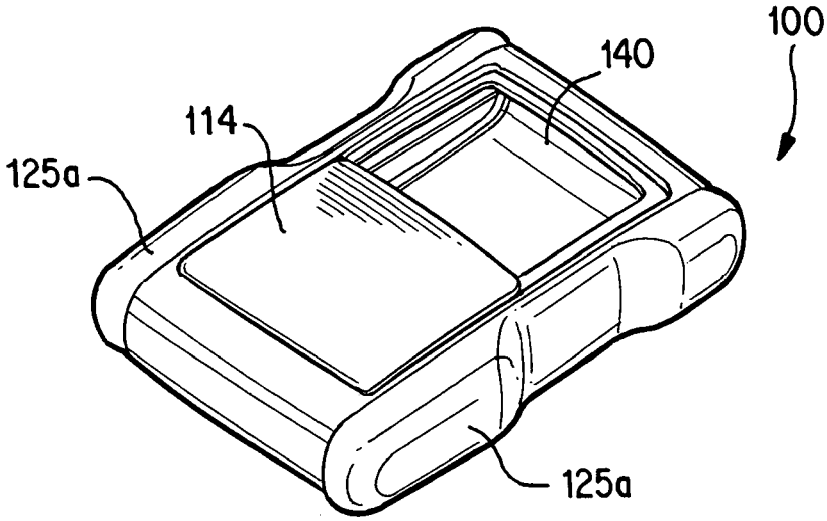
FIG. 15 is a frontal perspective view of the container of FIG. 9 with the lid in an open state.

A second embodiment of a pocketsize hand-held container 100, depicted in FIGS. 9-15, includes first and second frame sections 122*a*, 124*a* that are attached as described in connection with the previous embodiment, or possibly hinged together at their top ends, such as by a living hinge (not shown). The frame sections can be placed together to form the frame configuration shown in FIG. 9. Separate cheek members 125*a*, 125*a* formed of a flexible material are inserted at each side of the frame in order to provide a gripping surface, as well as to hold the sections together. There is employed a sliding lid 114 which can be slid along the longitudinal axis L of the container to open and close the access opening 140, as shown in FIGS. 13, 14.

Figure 12:
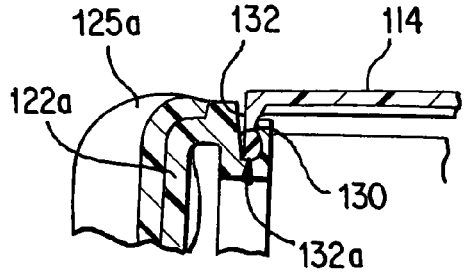
FIG. 12 is an enlarged fragmentary view of FIG. 11.
Figure 11:
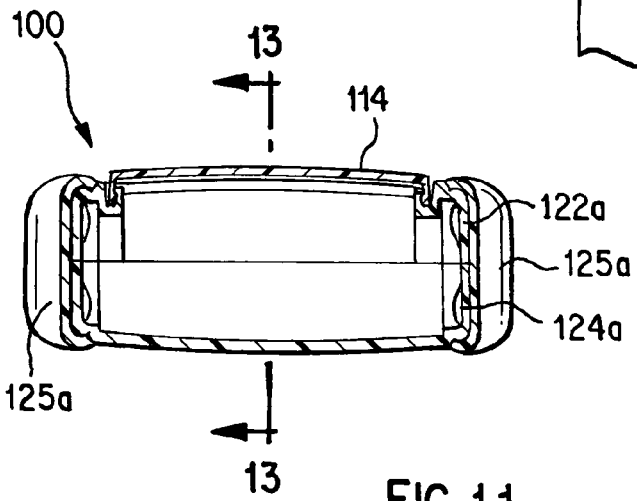
FIG. 11 is a sectional view taken along the lines 11-11 in FIG. 10.

The second frame section 124*b* includes a pair of parallel, forwardly open slots or channels 130 extending along respective sides of the container which extend only partially through the first frame section (FIG. 12). The lid includes a pair of downwardly projecting rails or guide strips 132 that are received in the slots and are slidable longitudinally therein. A front end or mouth of each slot is narrower than a back portion of the slot, and the back ends of the rails 132 have enlargements or beads 132*a* which enable the rails to enter the slots with a snap action and be retained therein against dislodgement. The front portion of the second section 124*a* includes an edge which borders a bottom end of the container's access opening, the edge including an upwardly projecting tongue 160 (FIG. 14) extending in a width-wise direction of the container. A bottom portion of the lid includes a downwardly open recess in which the tongue is received, in order to hold the lid in a closed state. By applying a downward force to the lid, the lid can be pushed free of the tongue and moved to an open position in a direction parallel to a plane of the access opening, as shown in FIG. 17. To close the access opening, the lid is pushed in the opposite position until the tongue 60 snaps back into the groove.

A top edge of an front surface of the lid can be provided with a cut-out 164 (FIG. 10) to facilitate the ability of a user's finger to apply a downward force to open or close the lid. Also, or alternatively, that top edge could be somewhat beveled at 165 as shown in FIG. 13. This embodiment offers the advantages of the earlier described embodiment in being holdable and manipulated by one hand.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims. For example, the shape and appearance of the container may vary significantly from those of the preferred embodiments. In lieu of a bag, the items could simply be placed directly into the compartment formed by the container, in a tray seated in the compartment and covered by removable film such as foil.

What is claimed is:

1. A pocket-size hand-held container for containing a supply of consumer items comprising:

a frame having an internal storage compartment, the frame including front and back portions, and top and bottom portions spaced apart in a longitudinal direction of the container and interconnected by side portions, wherein the front portion forms an access opening to the storage compartment, the access opening disposed closer to the top end portion than to the bottom end portion, a lid attached to the front portion to be slid linearly in the longitudinal direction between closed and open positions, wherein:

in a fully closed position, the lid overlying the access opening, and in a fully open position, the lid exposing the access opening and situated within the footprint of the container; and a securement structure formed by the lid and the frame for yieldably holding the lid in the fully closed position, wherein the front portion includes a pair of slots extending generally parallel to the side portions and the lid including a pair of downwardly protruding rails slidably disposed in the slots; each rail includes a downwardly projecting rib having an enlarged head at its back end, the head including an upwardly facing surface underlying a downwardly facing surface of the front portion; and each enlarged head includes a downwardly facing surface which is beveled upwardly from the respective rib to define a wedge surface enabling the rails to be snapped downwardly into the respective slots.

2. The pocket-size hand-held container according to claim 1 wherein the securement structure is arranged to frictionally hold the lid in the fully closed position.

3. The pocket-size hand-held container according to claim 1 wherein the frame comprises a front part and a back part joined along a parting line disposed closer to the front part than to the back part.

4. The pocket-size hand-held container according to claim 3 wherein the front part forms front sections of the top and bottom portions and front sections of the side portions; the back part forming the back portion and back sections of the top and bottom portions and back sections of the side portions.

5. The pocket-size hand-held container according to claim 1 wherein each side portion includes top and bottom regions spaced apart by an intermediate region which is recessed with respect to the top and bottom regions.

6. The pocket-size hand-held container according to claim 1 wherein the front portion includes a front surface; a main portion of the lid arranged to overlie the access opening and spaced above the front surface by ridges disposed between the front surface and an underside of the lid.

7. The pocket-size hand-held container according to claim 6 wherein the ridges are integral with the underside of the lid.

8. The pocket-size hand-held container according to claim 6 wherein the front surface is concave as viewed in a direction toward the bottom portion of the container.

9. The pocket-size hand-held container according to claim 3 wherein the top and back parts are secured together by pin-and-socket connections.

10. The pocket-size hand-held container according to claim 1 wherein the underside of the lid is configured symmetrically about a plane extending parallel to the top and bottom direction, wherein the lid can be installed correctly in either of two orientations in the front portion.

11. A pocket-size hand-held container for containing a supply of consumer items comprising:

a frame having an internal storage compartment, the frame including front and back portions, and top and bottom portions spaced apart in a longitudinal direction of the container and interconnected by side portions, wherein the front portion forms an access opening to the storage compartment, the access opening disposed closer to the top end portion than to the bottom end portion, a lid attached to the front portion to be slid linearly in the longitudinal direction between closed and open positions, wherein:

in a fully closed position, the lid overlying the access opening, and in a fully open position, the lid exposing the access opening and situated within the footprint of the container;

a securement structure formed by the lid and the frame for yieldably holding the lid in the fully closed position; and a flexible bag disposed in the storage compartment and containing the items, the bag including a manually openable window disposed beneath the access opening.

12. The pocket-size hand-held container according to claim 11, wherein the window is resealable.

13. The pocket-size hand-held container according to claim 11 wherein the window is removable from the rest of the bag.

14. The pocket-size hand-held container according to claim 11 wherein the items comprise smokeless tobacco products.

15. A pocket-size hand-held container for a supply of consumer items comprising:

a frame comprised of front and back parts secured together and forming a storage compartment enclosed by front and back portions, top and bottom portions spaced apart in a longitudinal direction of the container, and two side portions each interconnecting the top and bottom portions;

each side portion including top and bottom regions and an intermediate region recessed with respect to the top and bottom regions;

the front portion including an front surface in which is formed an access opening to the compartment, the access opening disposed closer to the top portion than to the bottom portion;

a lid including a pair of downwardly projecting rails slidably secured in respective longitudinal slots of the front portion wherein the lid is slidable linearly in the longitudinal direction between closed and open positions, wherein:

in a fully closed position, the lid overlying the access opening, and retained in the fully closed position by a yieldable securement;

in a fully open position, the lid exposing the access opening and overlying a portion of the front surface disposed downwardly of the access opening and lying within the footprint of the container; and a flexible bag disposed within the compartment and containing the items, the bag including a manually openable window disposed beneath the access opening.

16. The pocket-size hand-held container according to claim 15 wherein the lid includes a main portion for overlying the access opening, and a pair of downwardly extending longitudinal ridges slidably engaging the front surface to maintain the main portion of the lid spaced above the front surface.

17. The pocket-size hand-held container according to claim 15 wherein the bag contains smokeless tobacco items.

* * * * *